US005666785A

United States Patent [19]

Jouffreau et al.

[11] Patent Number: 5,666,785

[45] Date of Patent: Sep. 16, 1997

[54] METHOD AND APPARATUS FOR IN-LINE PRINTING ON A WATER SOLUBLE FILM

[75] Inventors: Christian Jouffreau, Nemours; Jean-Pierre Naude Filonniere, Veneux Les Sablons, both of France

[73] Assignee: Chris-Craft Industrial Products, Inc., South Holland, Ill.

[21] Appl. No.: 413,031

[22] Filed: Mar. 28, 1995

[51] Int. Cl.[6] ..... B65B 61/02

[52] U.S. Cl. ..... 53/411; 53/451

[58] Field of Search ..... 53/411, 131.4, 53/131.5, 131.2, 451; 101/327, 333, 334, 491; 206/0.5

[56] References Cited

U.S. PATENT DOCUMENTS

| | | | |
|---|---|---|---|
| 3,596,428 | 8/1971 | Young | 53/451 |
| 3,695,989 | 10/1972 | Albert . | |
| 3,771,448 | 11/1973 | Thomson et al. | 101/334 |
| 3,892,905 | 7/1975 | Albert . | |
| 4,154,636 | 5/1979 | Motoyama et al. | 53/441 |
| 4,263,845 | 4/1981 | Okamura | 53/411 |
| 4,307,555 | 12/1981 | Mlodozeniec et al. | 53/53 |
| 4,432,281 | 2/1984 | Wall et al. | 101/334 |
| 4,681,228 | 7/1987 | Kerry et al. . | |
| 4,806,261 | 2/1989 | Ciallella et al. . | |
| 4,841,860 | 6/1989 | Fehling | 101/334 |
| 4,874,656 | 10/1989 | Rantanen . | |
| 5,139,152 | 8/1992 | Hodakowski et al. . | |
| 5,330,047 | 7/1994 | Gouge et al. . | |

FOREIGN PATENT DOCUMENTS

WO89/12587 12/1989 WIPO .

*Primary Examiner*—Lowell A. Larson
*Assistant Examiner*—Ed Tolan
*Attorney, Agent, or Firm*—Jenner & Block

[57] ABSTRACT

A method and apparatus is provided for printing on a water soluble film for use in-line on a packaging machine. Typically, the packaging machine will form a web from a roll of water soluble film and transport the film web toward a forming, filling and sealing station where the web is formed into the shape of a container, filled with a substance and sealed to form a water soluble container. A printer in accordance with the present invention can be mounted to the packaging machine for printing on the film web while the packaging machine has temporarily halted transportation of the web. The printer includes a printing head with an engraved face which is applied to the film web by a suitable actuating device. Ink is supplied to the engraved face by pressing the printing head against an ink-absorbent pad. The actuating device includes a mechanism for rotating the printing head 180° so that the engraved face of the printing head faces the film web during printing and the ink absorbent pad when the printer is idle. The printer can also include a pressure regulating device for absorbing energy from the motion of the printing head as it makes contact with the film web, thus protecting the film web from damage and assuring that a cleaner image is printed on the film web.

19 Claims, 3 Drawing Sheets

METHOD AND APPARATUS FOR IN-LINE PRINTING ON A WATER SOLUBLE FILM

FIELD OF THE INVENTION

The invention relates to printing directly on water soluble film and more particularly to a method and apparatus for printing graphics and text directly on water soluble films while the film is in the process of being formed into a water soluble container by a packaging machine.

BACKGROUND OF THE INVENTION

It is well known that water soluble film material such as polyvinyl alcohol or methylhydroxylpropyl cellulose, for example, can be used to form the walls of a water soluble container or package. Typically, such a container is filled with a liquid or solid water soluble or dispersable substance and sealed, thus forming a package that dissolves completely when immersed in water.

Water soluble packaging has many advantageous commercial applications. For example, water soluble packaging is frequently used to contain potentially harmful materials, such as pesticides, which are produced as concentrated solutions or powders that must be dispersed in water or other organic liquid before use. Packaging such materials in water soluble containers overcomes many potential hazards. First, because water soluble packaging is pre-sealed, there are no airborne particles that could be ingested by, or otherwise contact, the user in contrast with conventional packaging which must be opened prior to use. Second, water soluble packages are filled with precise quantities of the chemical, thereby preventing waste through over charging or under charging. Finally, water soluble packaging is biodegradable and dissolves completely in water so that there is no potentially hazardous or environmentally destructive packaging material to be discarded.

Water soluble containers are typically formed by large, single unit packaging machines. In such machinery, large rolls of water soluble film are unwound into a web and transported by rollers toward a forming station where segments of the film web are folded into the shape of a container, sealed on the bottom and sides, filled with water soluble material and sealed at the top to form a leak-proof container. Because environmental conditions can adversely affect the properties of most water soluble films, the packaging machines are usually placed in special rooms where temperature and relative humidity are carefully controlled according to the film manufacturer's specifications.

It is highly desirable that the outside of the water soluble package be labeled with manufacturer's indicia or other consumer information. Indeed, where the packaging contains hazardous materials, informational labeling, such as instructions for use of the article or safety warnings, may actually be required by law or by regulatory agencies. Other indicia, such as article identification or the manufacturer's name and trademarks, provide the consumer with useful, and often necessary, information about the article. In addition, it is desirable that such information be printed directly on the outside walls of the container rather than on separate paper or other labels that are affixed to, and thus become part of, the container, thereby rendering the container partially insoluble.

Typically, direct labeling of water soluble packages is accomplished by printing on the water soluble film material in a special process before the film is installed on a packaging machine. In many instances, the pre-printing process requires rolls of water soluble film to be unwound, printed using an ink jet printer or other process such as flexography or heliography, and then heated so that the ink will dry on the film. The film is then rewound into rolls and delivered to the packaging process.

There are, however, a number of drawbacks associated with this printing method. First, this printing process requires the use of non-water soluble ink which can interfere with the solubility of the container walls when used. Second, it is difficult to print graphics using this method. Third, applying heat to dry the ink on the film can adversely affect the solubility of the packaging material. Finally, this separate, off-line printing process requires extra handling of the material which adds significantly to the cost of producing water soluble packages.

Thus, there has been a need for a method and apparatus for printing text and graphics on water soluble films that does not interfere with the characteristics of the material and which minimizes handling and disruption of the packaging process. Furthermore, there has been a need for an in-line printing process that can be installed with and operate in-line with a standard water soluble film packaging machine.

SUMMARY OF THE INVENTION

In accordance with the present invention, a method and apparatus for printing directly on water soluble films is provided that is particularly suitable for use in-line with a water soluble film packaging machine. More specifically, the present invention provides methods of printing text and graphics, or both, on a water soluble film while the film is being formed into a water soluble container by a packaging machine.

The present invention provides a printer that can be used with a variety of standard packaging machines. The printer includes a housing that contains a printer mechanism having a supply of water soluble ink. The printer mechanism drives a printing head and applies it to a desired region on one side of the water soluble film web. The printing process initiates when the packaging machine halts film web transport temporarily during the form, fill and seal cycle that produces the water soluble container. As a result of printing by the method of this invention, the film can be appropriately labeled without interrupting or delaying the normal packaging process.

In accordance with one embodiment of the present invention, the printing head has an engraved face for stamping the desired text or graphics onto the water soluble film web and the ink supply comprises an ink-absorbent pad. The printing head is supplied with ink by pressing the engraved face against the ink-absorbent pad, which can be continuously supplied with fresh ink by any suitable commercially available device. This reliable method of printing and ink supply assures that the mechanism can be inexpensively built and that water soluble ink can be used in the printing process.

In one embodiment, the ink absorbent pad faces upwards and printing occurs on the underside of the water soluble film web in the packaging machine. As a result, the printing mechanism includes a structure for rotating the printing head 180° so that it faces, alternatively, the ink supply and the printing surface on the film web. Preferably, the rotating mechanism comprises a horizontal shaft connected to the printer at one end and rotatably connected to a vertical actuator at its other end. The vertical actuator can be a pneumatic or hydraulic driven cylinder or cylinders, for example. The actuator lifts the shaft upward through a generally vertical slot in the housing of the printer. The slot includes a curved section and the housing has a pivot point protruding toward the printer from the inner radius of the curved slot. In operation, as the shaft encounters the curved section of the vertical slot, the printing head pivots about the protrusion, thereby rotating 180° so that the printing head faces the target printing area. During the retraction stroke, the printing head reverses its course so that the printing head again faces the ink pad when at rest.

In accordance with another aspect of the invention, the printing apparatus includes a pressure regulating device for modulating the force of contact between the printing head and the printing surface on the water soluble film. The pressure regulator slows the printing head as it contacts the film to minimize undesired vibrations, thereby promoting uniform and clear printing on the film surface. In addition, the pressure regulator controls the pressure at which the printing head is applied to the film, to minimize the possibility of damage to the film during printing.

Other advantages and features of the invention will be apparent from the following description and from the drawings.

DETAILED DESCRIPTION OF THE PREFERRED EMBODIMENT

Figure 1:
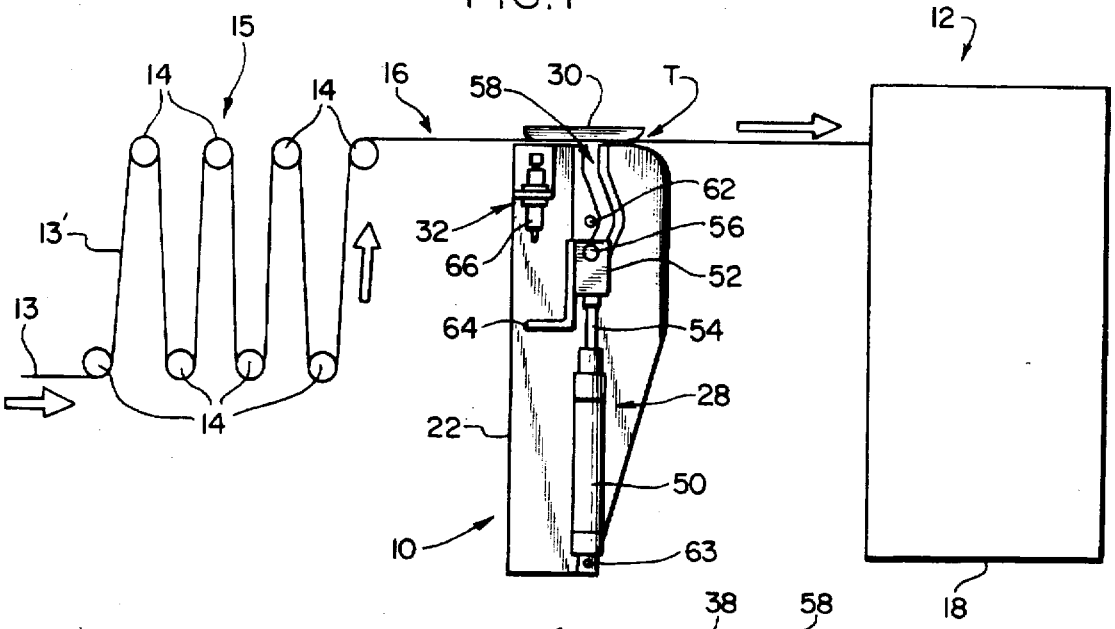
FIG. 1 is a side elevation view of a water soluble film printing apparatus in accordance with the present invention shown installed in-line with a packaging machine.

FIG. 1 illustrates a printer 10 in accordance with the present invention shown installed in-line with a water soluble packaging machine 12. Packaging machine 12 operates automatically and continuously, forming, filling and sealing water soluble films to produce water soluble packages or containers. Packaging machine 12 is not shown or described in detail, since such packaging machines are well known in the art. Any of a variety of water soluble material, such a polyvinyl alcohol or methylhydroxylpropyl cellulose, can be accepted by packaging machine 12 in its operation.

Packaging machine 12 has a loading section (not shown) for accepting rolls of water soluble film 13. Film 13 is unrolled into a web 13' and transported rearward for processing. First, film web 13' travels through a stretching section 15 of successive 90° turns driven by dancing rollers 14, which slightly tension and stretch the film to control its thickness and remove any wrinkles. The film then travels through a straight transition section 16 prior to entering forming and filling station 18. Within station 18, film web 13' is formed into the shape of a container and filled with the material to be packaged (not shown). The container opening is then heat sealed and the film web is cut to form a leak proof, water soluble container (not shown). Packaging machine 12 is of conventional design, and a number of commercially available packaging machines can be used with the present invention where the film web of packaging material stops intermittently to permit the printing operation of printer 10. For example, printer 10 can be used with vertical form, fill and seal ("VFFS") packaging machines manufactured by Bosch, Hayssen and UVA Butler, to name but a few.

Figure 2:
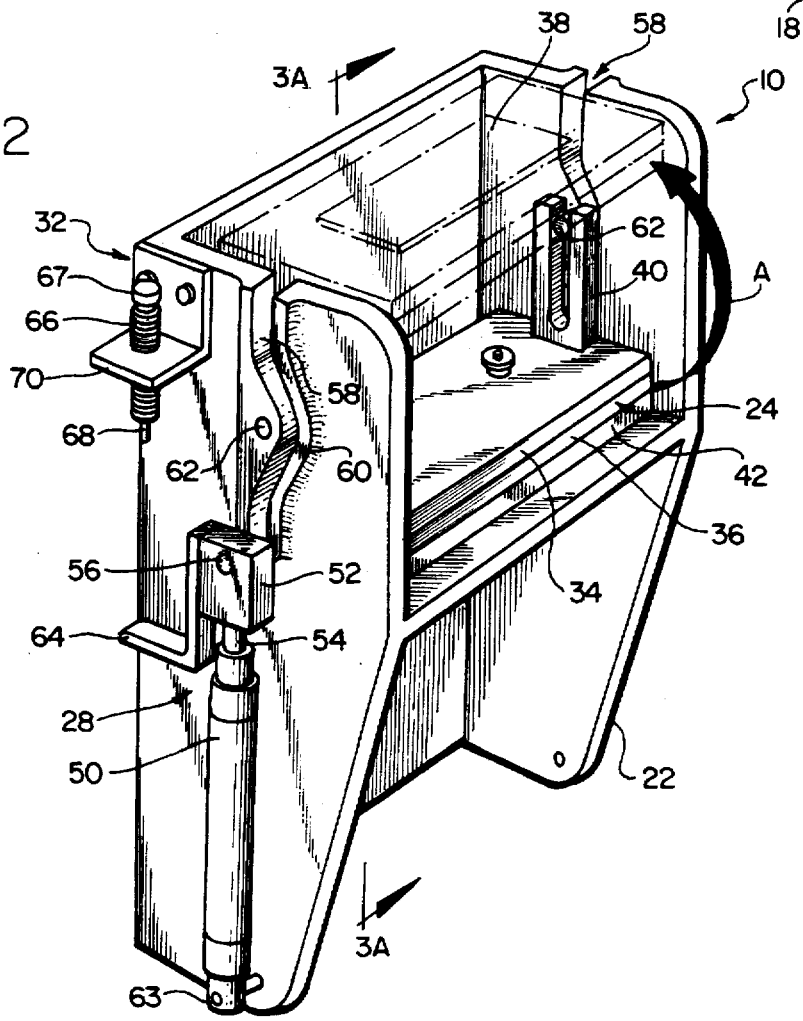
FIG. 2 is a perspective view of a printing apparatus in accordance with the present invention.

In accordance with the present invention, printer 10 is installed on packaging machine 12 within transition section 16. As best seen in FIG. 2, printer 10 includes a housing 22 which holds a movable printing head 24 for printing a target section T of film web 13' with text and graphics using a water soluble ink. An ink supply 26 is located within housing 22 for supplying printing head 24 with fresh ink prior to the beginning of a printing cycle. A drive mechanism 28 applies printing head 24 to film web target area T during the printing cycle and returns printing head 24 to ink supply 26 upon termination of the printing cycle. A top plate 30 is mounted above housing 22 so that film target area T lies between plate 30 and housing 22. Top plate 30 restricts the upward movement of printing head 24 so that a clear image is stamped onto target area T of the film. Printer 10 also includes a pressure regulating device 32 for regulating the pressure at which drive mechanism 28 applies printing head 24 to film section T to be printed.

Figure 4:
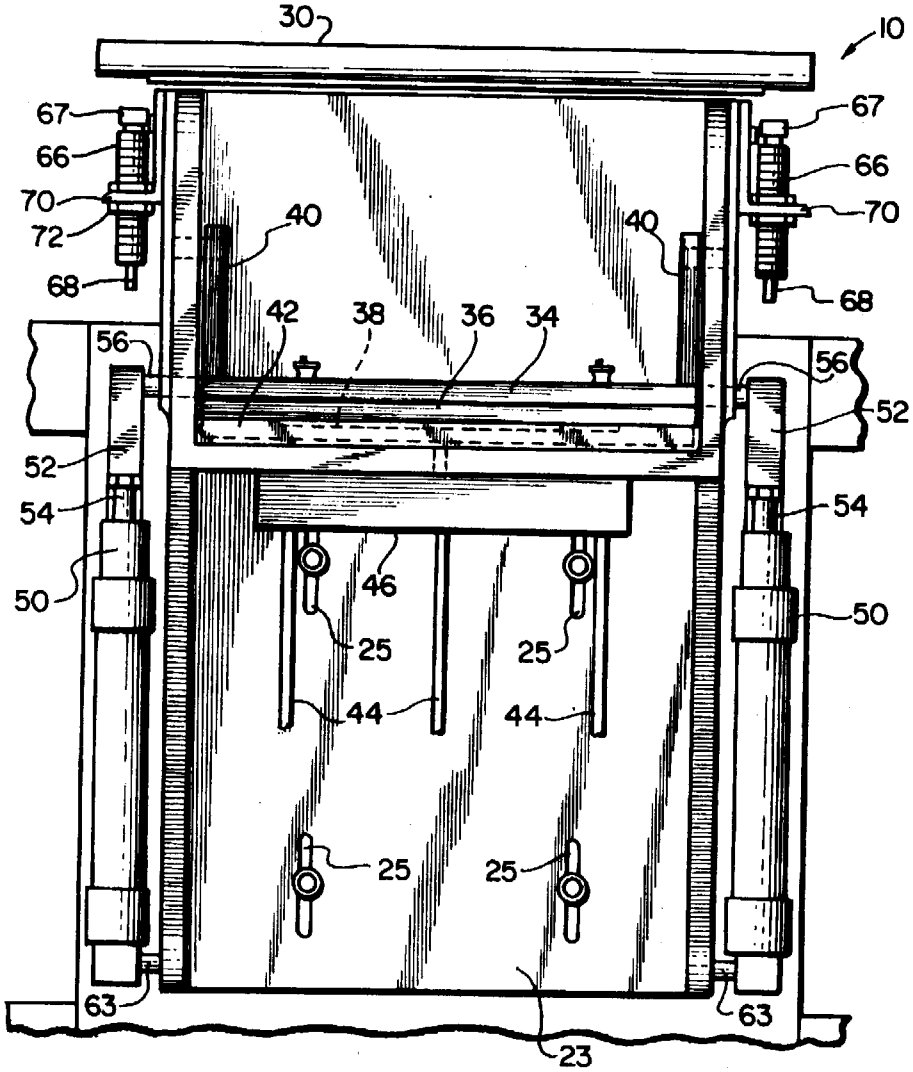
FIG. 4 is a sectional view of the printing apparatus.

Housing 22 is adapted for installation on a variety of commonly available packaging machines 12. As best seen in FIG. 4, housing 22 includes a back mounting plate 23 having four adjustable mounting slots 25 for bolting the printer to packaging machine 12. A simple adjusting device (not shown) can be added comprising a pair of screws (not shown) contacting the bottom of each side of housing 22, each screw having an adjusting nut (not shown) for altering the screw position relative to housing 22 to align housing 22 and printing head 24 properly with respect to film target area T. Printer 10 is of narrow profile so that it can be installed in the space provided between section 12 and forming and filling station 18 on most commercially available packaging machines 12.

As best seen in FIGS. 2 and 3A—3C, printing head 24 is adapted to travel vertically within housing 22. Printing head 24 comprises a stamp 38, a carrier 36 and a moving plate 34. Stamp 38 is affixed to carrier 36 which is bolted to moving plate 34. Moving plate 34 is rotatably connected to drive mechanism 28 providing the motive force for driving printing head 24 within housing 22. Printing head 24 comprises an engraved face forming stamp 38 for the text and graphics to be printed. Stamp 38 is preferably attached to carrier 36 with double sided tape. In addition, two U-shaped guides 40 are rigidly mounted to the surface of moving plate 34 on the side opposite stamp carrier 36. U-shaped guides 40 guide printing head 24 during its vertical movement, and also provide a means for pivoting printing head 24, as described more fully below.

The details of ink supply 26 are best illustrated in FIG. 4. In the preferred embodiment, ink supply 26 is mounted at the bottom of housing 22 facing the target section of the film to be printed. Ink supply 26 comprises an ink-absorbent pad 42, which is kept moist with a fresh supply of ink from an ink tank (not shown) through a manifold section (not shown) into ink supply lines 44 (shown cut away in FIG. 4) which feed individual ink delivery ports 46 beneath pad 42. The flow of ink through supply lines 44 can be controlled by commercially available ink flow controllers (not shown) operatively connected to packaging machine 12 and printer 10. A suitable ink flow controller is manufactured by Tiflex Corporation and sold under the trade designation "DEE". Preferably, the ink used by ink supply 26 is a fast-drying, water soluble ink having a viscosity of between 70 and 90 centipoises at 22° C. Advantageously, ink supply 26 can use a water soluble ink which does not interfere with the solubility of the film when printed. Suitable ink is available from Colorcon Corporation under the trade designation "NO.TOX NT08A" and from Tiflex Corporation under the trade designation "XC325". Since such ink is edible, it can be used in food applications.

While at rest, stamp 38 of printing head 24 presses against ink-absorbent pad 42, which is continuously replenished with fresh ink by the ink flow regulators. Thus, stamp 38 of imprinting head 24 is coated with a fresh supply of ink prior to each printing cycle. During the printing cycle, drive mechanism 28 lifts the printing head 24 from pad 42 and flips printing head 24 180° so that stamp 38 faces film target area T and presses the freshly inked face of stamp 38 against target area T, thereby printing the desired image on film web 13'.

It will be appreciated that because of the in-line placement of ink supply 26, printing head 24 and drive mechanism 28 within housing 22, printer 10 occupies only a small amount of longitudinal web space when installed. Indeed, in a constructed embodiment of the present invention, the total width of a printer carrying a stamp 95 mm wide is only 140 mm. As a result of its narrow profile, printer 10 can be installed in the unused space on a variety of existing packaging machines in retrofit installations.

Figure 3A:
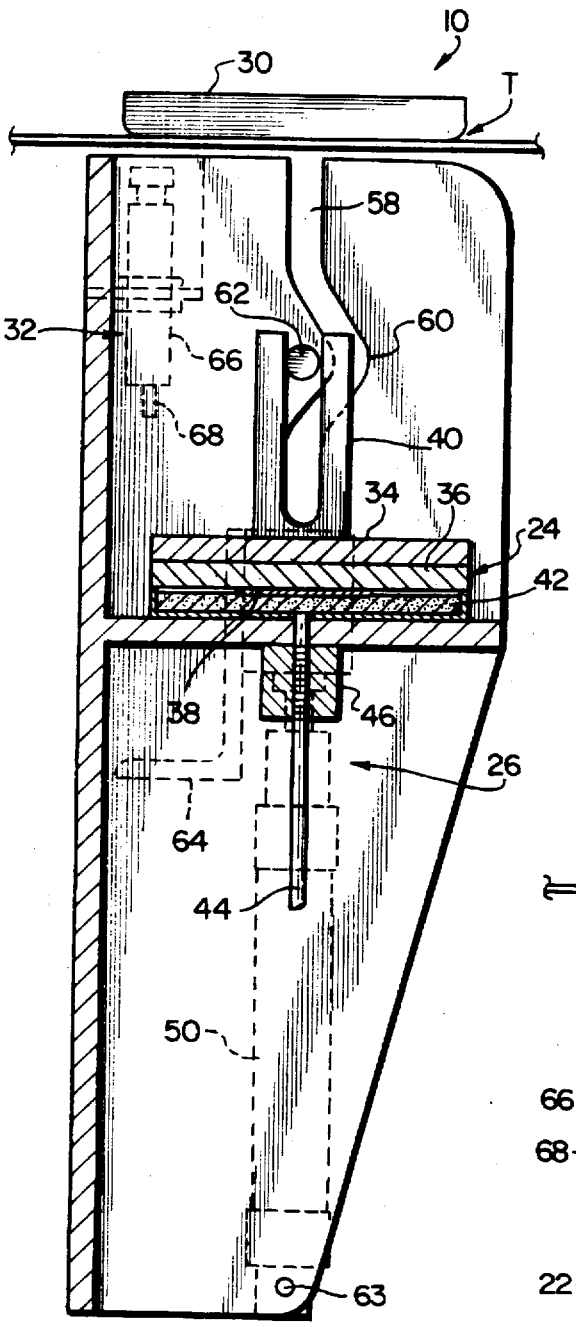
FIGS. 3A, 3B and 3C are sectional views of the printing apparatus along lines 3A—3A of FIG. 2 illustrating the printing head of the printing apparatus in its rest, intermediate and applied positions, respectively.
Figure 3B:
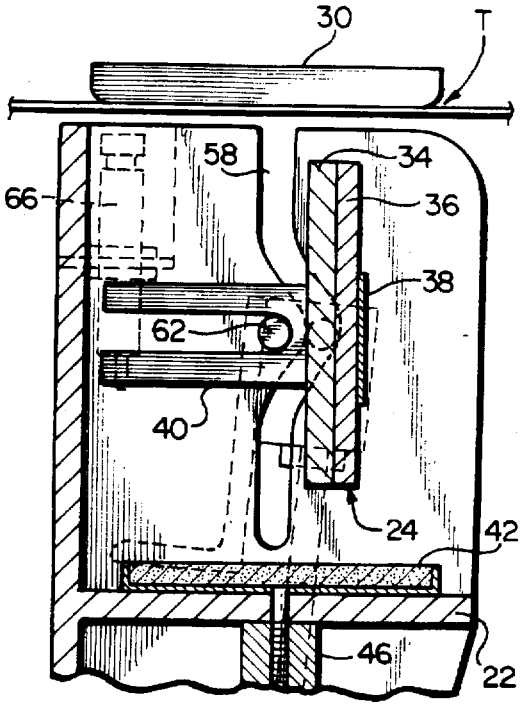
Figure 3C:
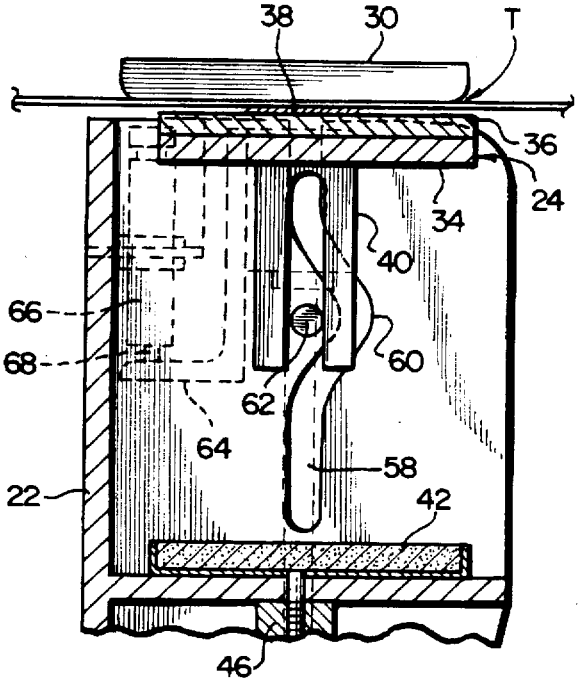

Details of drive mechanism 28 can be best understood by referring to FIGS. 3A—3C. Drive mechanism 28 comprises a vertical actuator that is connected to moving plate 34 of printing head 24. In the preferred embodiment, pneumatic cylinders 50, pivotally mounted on opposite sides of housing 22 at pivot points 63, provide the upward force for lifting printing head 24 during the printing cycle. Cylinders 50 are supplied with compressed air at a pressure of at least 65 PSI through an air flow regulator (not shown) of conventional design. Although cylinders 50 are pneumatic in the preferred embodiment, it will be appreciated that a variety of alternative actuators could be used. For example, cylinders 50 could be hydraulically actuated.

A plate holder 52 provides the linkage between cylinders 50 and printing head 24 in combination with pin 56. Holder 52 is connected to cylinders 50 at the end of each piston rod 54 and to moving plate 34 of printing head 24 by means of pin 56 extending through housing 22. Pin 56 is free to rotate within moving plate holder 52. Pin 56 moves through a pair of vertical slots 58, one located in each side of housing 22. During the printing cycle, cylinder 50 is pressurized and piston rod 54 is pushed outward moving pin 56 vertically upward through slot 58, thus lifting printing head 24 towards the film target area T.

As previously noted, drive mechanism 28 must rotate printing head 24 180°, as shown by arrow A of FIG. 2, during operation so that printing head 24 can be pressed against target area T of the film during the printing cycle and returned to its original position, pressed against ink-absorbent pad 42, at the end of the printing cycle. The structure for accomplishing this function can be best understood with reference to FIGS. 3A–3C. As seen in the FIGS., each slot 58 has an outwardly curved section 60. At the inner radius of curved section 60, a nub 62 protrudes from housing 22 towards the interior of housing 22. The outside diameter of nub 62 is less than the width of the inner slot of U-shaped member 40 so that hub 62 slides within U-shaped member 40 during the movement of printing head 24.

In operation, nub 62 acts as a pivot point about which printing head 24 rotates. When printer 10 begins a printing cycle, cylinders 50 expand lifting the printing head 24, with nub 62 thereby sliding within the inner slot of each U-shaped member 40. As cylinder piston rods 54 and holders 52 continue their upward vertical travel, pin 56 swings outward within curved section 60 of slot 58 and cylinders 50 pivot about pivot points 63 to accommodate this movement. The outward movement of pin 56 forces printing head 24 slightly outward from housing 22. Simultaneously, the innermost section of U-shaped member 40 pushes against nub 62 pivoting printing head 24 about nub 62. As pin 56 completes its upward travel through the remainder of curved section 60 (returning to the upper straight portion of slot 58), printing head 24 is rotated exactly 180° so that stamp 38 now faces the film target area, as shown in FIG. 3C. At the completion of the printing cycle, printing head 24 is pressed against the film target area T between stamp 38 and upper plate 30 leaving the desired impression upon the film. During its retraction stroke, printing head 24 again rotates 180° about nub 62 as it is lowered so that stamp 38 faces ink-absorbent pad 42 when printer 10 is idle. It will be appreciated that the structure for rotating printing head 24 involves a minimum number of moving parts, which simplifies the manufacturing and maintenance of printer 10 and significantly lowers the cost of the device.

As printing head 24 makes contact with the film, a pressure regulating device 32 mounted to each side of housing 22 assures delicate and uniform application of stamp 38 to the film target area. Pressure regulating device 32 comprises two L-shaped brackets 64 that are mounted to each moving plate holder 52 and two dampers 66 that are bolted to each side of housing 22 by means of adjustable brackets 70 just above each L-shaped bracket 64. As printing head 24 is moved into contact with film target area T, L-shaped bracket 64 makes contact with a stem 68 protruding downward from each damper 66. Dampers 66 are adjustable hydraulic shock absorbers that remove energy from printing head 24 motion as it makes contact with the film. The damping effect minimizes vibrations in stamp 38, which promotes uniform and clear printing. A suitable damper is commercially available from Enedine Corporation and is sold under the name "Adjustable OEM" (model "OEM.25MB"). In addition, the air flow regulators (not shown) regulate the pressure of air supplied to pneumatic cylinders 50 and, thus, control the force of contact between stamp 38 and film target area T to minimize the possibility of damage to the film during printing.

Figure 5:
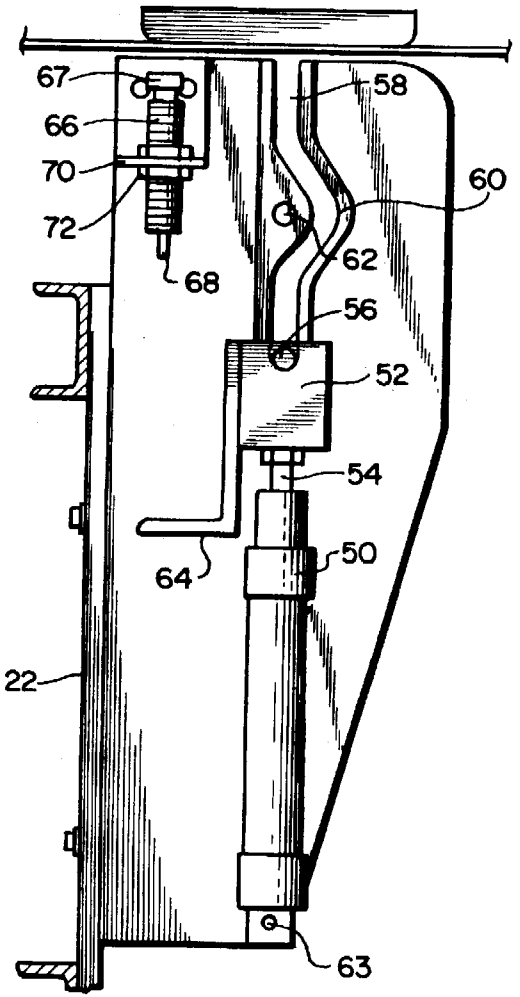
FIG. 5 is a side elevation view of the printing apparatus of FIG. 4.

Dampers 66 can be adjusted in two ways to vary the dampening effect on printing head 24 motion during printing. First, as best seen in FIG. 5, damper 66 is held within mounting bracket 70 by an adjustment nut 72. The position of damper 66 within bracket 70 can be adjusted by loosening nut 72 and sliding damper 66 up or down. By lowering damper 66 more dampening force will be applied to printing head 24, and by raising damper 66 less dampening force will be applied to printing head 24. Second, a knob 67 at the top of damper 66 can be adjusted to control the hydraulic pressure exerted on stem 68, which, in turn, controls the dampening force applied to printing head 24.

When installed, printer 10 is adapted to work in-line with packaging machine 12. During each form, fill and seal cycle, packaging machine 12 temporarily halts film transport in order to produce water soluble containers within forming and filling station 18. At this time, packaging machine 12 signals printer 10 to begin a new printing cycle. A printing dwell timer (not shown) controls the duration of the printing cycle. The timer starts when the pneumatic controllers of drive mechanism 28 pressurize cylinders 50 to initiate printing. When the timer reaches a predetermined setpoint, the air flow regulator of drive mechanism 28 is triggered to reverse the flow of air through cylinders 50 and lower printing head 24 away from film web target area T. The setpoint of the printing timer is user-adjustable to accommodate packaging machines 12 having different speeds of operation. As a result, printer 10 prints the desired text and graphics on the film without interrupting the packing process. Alternatively, many VFFS machines are equipped with a printing timer that can be controlled by the machine operator to vary the printing time.

While the invention has been described with respect to certain preferred embodiments, it is to be understood that the invention is capable of numerous changes, modifications and rearrangements without departing from the scope or spirit of the invention as defined in the claims.

We claim:

1. A method of producing printed water soluble film packages containing a quantity of a material, comprising:

transporting a web of water soluble film in a packaging machine from a roll of water soluble film to a filling stage of the packaging machine where the web is periodically formed, filled and sealed into a water soluble package and transversely divided while the web is stopped;

printing directly on the water soluble film with water soluble ink to form the printed mattes at a printing location between the film roll and the filling stage when the web is stopped for transverse division; and thereafter forming the water soluble package from the web having the printed matter thereon;

filling the package with the material to form a filled package;

sealing the filled package; and transversely dividing the web.

2. The method of claim 1 wherein the printing step comprises pressing an engraved printing head against the water soluble film and removing the printing head from the water soluble film.

3. The method of claim 2 wherein the printing step further comprises supplying ink to an ink-absorbent pad and pressing the printing head against the ink-absorbent pad.

4. The method of claim 3 wherein the printing step further comprises rotating the printing head so that it faces the ink-absorbent pad and the water soluble film, alternatively.

5. The method of claim 2 further comprising the step of regulating the pressure at which the printing head contacts the water soluble film.

6. The method of claim 5 wherein the step of regulating the pressure of contact comprises absorbing energy from the printing head as it makes contact with the water soluble film.

7. The method of claim 1 further comprising the step of detecting when the film web has stopped for transverse division in the filling stage and initiating the printing step in response thereto.

8. The method of claim 1 wherein the printing step is carried out from underneath the film web.

9. The method of claim 2 further comprising the step of timing the printing step and initiating the removing step after a predetermined time interval has elapsed.

10. The method of claim 1 wherein the printing step is performed after the water soluble film leaves the roll and prior to the web entering the packaging machine.

11. In a method of producing printed water soluble film packages for use in-line with a packaging device having a first stage for in which a web of water soluble film is formed and transported from a roll of water soluble film to a second stage for forming, filling and sealing the water soluble film into packages, the improvement comprising the steps of:

supplying water soluble ink to a printing head; and printing on one side of the film web located at a point between the first stage and the second stage of said packaging device when said packing device has temporarily halted transport of said film sheet.

12. The method of claim 11 wherein the printing step comprises pressing an engraved printing head against the film web and removing the printing head from the film web.

13. The method of claim 12 wherein the step of supplying ink comprises supplying ink to an ink-absorbent pad and pressing the printing head against the ink-absorbent pad.

14. The method of claim 13 wherein the printing step further comprises rotating said printing head so that it faces the ink-absorbent pad and the film web, alternatively.

15. The method of claim 12 further comprising the step of regulating the pressure at which the printing head contacts the film web.

16. The method of claim 15 wherein the step of regulating the pressure of contact comprises absorbing energy from the printing head as it makes contact with the film web.

17. The method of claim 11 further comprising the step of detecting when the packaging device has stopped transporting the film web and initiating the printing step in response thereto.

18. The method of claim 11 wherein the printing step is carried out from underneath said film web being transported by said packaging device.

19. The method of claim 12 further comprising the step of timing the printing step and initiating the removing step after a predetermined time interval has elapsed.

* * * * *